US007694432B2

(12) United States Patent
Eriksson et al.

(10) Patent No.: US 7,694,432 B2
(45) Date of Patent: Apr. 13, 2010

(54) METHOD FOR DEHUMIDIFICATION

(76) Inventors: Niclas Eriksson, Södra Breviksvägen 48, SE-421 67 Västra Frölunda (SE); Lars Svenningsson, Jungmansvägen 27, SE-432 75 Träslövsläge (SE)

( * ) Notice: Subject to any disclaimer, the term of this patent is extended or adjusted under 35 U.S.C. 154(b) by 309 days.

(21) Appl. No.: 10/568,722

(22) Filed: Nov. 14, 2006

(65) Prior Publication Data

US 2007/0074420 A1 Apr. 5, 2007

(30) Foreign Application Priority Data

Aug. 21, 2003 (SE) ..... 0302277

(51) Int. Cl.
*F26B 3/34* (2006.01)

(52) U.S. Cl. ..... 34/266; 34/259; 34/328; 34/381; 34/406; 34/413; 34/497; 34/526; 62/304; 62/310; 110/245; 110/246; 432/15; 432/58; 71/11; 205/528; 203/11

(58) Field of Classification Search ..... 34/259, 34/266, 328, 381, 413, 406, 497, 526; 62/304, 62/311; 110/215, 246; 432/15, 58; 71/11, 71/12; 205/529; 203/11
See application file for complete search history.

(56) References Cited

U.S. PATENT DOCUMENTS 1,456,046 A * 5/1923 Ball ..... 210/609
3,545,093 A * 12/1970 Forster ..... 34/262
3,771,234 A * 11/1973 Forster et al. ..... 34/259
3,831,288 A * 8/1974 Stribling et al. ..... 34/259
3,914,381 A * 10/1975 Sugahara et al. ..... 423/305
3,977,089 A * 8/1976 Forster et al. ..... 34/264
4,050,900 A * 9/1977 Hobbs et al. ..... 422/189
4,055,001 A * 10/1977 Forster et al. ..... 34/264
4,221,680 A * 9/1980 Hardwick et al. ..... 588/11
4,242,220 A * 12/1980 Sato ..... 588/8
4,330,946 A * 5/1982 Courneya ..... 34/263
4,338,102 A * 7/1982 Otsuka et al. ..... 55/301
4,338,922 A * 7/1982 Moore ..... 126/714
4,409,740 A * 10/1983 Sousek ..... 34/376
4,592,291 A * 6/1986 Sullivan, III ..... 110/346
4,909,740 A * 3/1990 Rankin ..... 434/238
4,985,118 A * 1/1991 Kurematsu et al. ..... 159/47.3
5,003,143 A * 3/1991 Marks et al. ..... 219/685
5,028,516 A * 7/1991 Mukunoki et al. ..... 430/403
5,092,983 A * 3/1992 Eppig et al. ..... 208/323

(Continued)

FOREIGN PATENT DOCUMENTS

DE 4231897 A1 * 3/1994

(Continued)

*Primary Examiner*—Stephen M. Gravini
(74) *Attorney, Agent, or Firm*—Capitol City TechLaw

(57) ABSTRACT

The present invention concerns a method and apparatus for dehumidifying, drying or the like of different materials. The invention is developed primarily for dehumidification of sewage sludge (7), but it may be utilized for many different materials including foodstuffs as crispbread and pasta. The sludge (7) or other material is dehumidified or dried in a chamber (1) by means of thermal radiation. The thermal radiation is given by means of one or more elements (2) for thermal radiation. The thermal radiation is concentrated to one or more distinct wavelength ranges at which water has peaks for absorption of radiation energy. Air is circulated in the chamber (1), to take up moisture evaporated from the material.

15 Claims, 2 Drawing Sheets

U.S. PATENT DOCUMENTS

| | | | | |
|---|---|---|---|---|
| 5,211,723 | A * | 5/1993 | Khan | 48/197 R |
| 5,220,733 | A * | 6/1993 | Bothe et al. | 34/426 |
| 5,233,763 | A * | 8/1993 | Minnie, Jr. | 34/267 |
| 5,248,456 | A * | 9/1993 | Evans et al. | 264/401 |
| 5,259,962 | A * | 11/1993 | Later | 210/758 |
| 5,340,536 | A * | 8/1994 | Datar et al. | 422/23 |
| 5,373,646 | A * | 12/1994 | Wosnitza et al. | 34/256 |
| 5,375,344 | A * | 12/1994 | Ruefli et al. | 34/269 |
| 5,427,896 | A * | 6/1995 | Hayashi | 430/372 |
| 5,436,195 | A * | 7/1995 | Kimura et al. | 438/24 |
| 5,470,480 | A * | 11/1995 | Gray et al. | 210/632 |
| 5,472,720 | A * | 12/1995 | Rakhimov et al. | 426/241 |
| 5,476,634 | A * | 12/1995 | Bridges et al. | 422/22 |
| 5,487,873 | A * | 1/1996 | Bridges et al. | 588/249 |
| 5,492,569 | A * | 2/1996 | Nakada | 134/18 |
| 5,523,052 | A * | 6/1996 | Bridges et al. | 422/22 |
| 5,543,111 | A * | 8/1996 | Bridges et al. | 422/22 |
| 5,609,820 | A * | 3/1997 | Bridges et al. | 422/23 |
| 5,641,423 | A * | 6/1997 | Bridges et al. | 219/770 |
| 5,678,323 | A * | 10/1997 | Domingue et al. | 34/266 |
| 5,707,911 | A * | 1/1998 | Rakhimov et al. | 501/128 |
| 5,714,451 | A * | 2/1998 | Brouwer et al. | 510/324 |
| 5,868,940 | A * | 2/1999 | Gurfinkel | 210/695 |
| 5,954,970 | A * | 9/1999 | St. Louis | 210/710 |
| 5,974,688 | A * | 11/1999 | Domingue et al. | 34/269 |
| 6,080,711 | A * | 6/2000 | Brouwer et al. | 510/324 |
| 6,103,458 | A * | 8/2000 | Seki | 430/393 |
| 6,106,853 | A * | 8/2000 | Cox | |
| 6,197,835 | B1 * | 3/2001 | Ganan-Calvo | 516/10 |
| 6,243,968 | B1 * | 6/2001 | Conrad et al. | 34/255 |
| 6,248,217 | B1 * | 6/2001 | Biswas et al. | 204/157.4 |
| 6,402,957 | B1 * | 6/2002 | Boyce | 210/652 |
| 6,464,886 | B2 * | 10/2002 | Ganan-Calvo | 210/758 |
| 6,465,144 | B1 * | 10/2002 | Hashimoto et al. | 430/106.1 |
| 6,618,957 | B2 * | 9/2003 | Novak et al. | 34/264 |
| 6,644,200 | B1 * | 11/2003 | Badger | |
| 6,649,065 | B2 * | 11/2003 | Boyce | 210/652 |
| 6,660,112 | B1 * | 12/2003 | Badger | |
| 6,668,725 | B2 * | 12/2003 | Badger | |
| 6,710,199 | B2 * | 3/2004 | DeBruin et al. | 558/114 |
| 6,794,127 | B1 * | 9/2004 | Lafferty et al. | 435/4 |
| 6,799,589 | B2 * | 10/2004 | Inagaki | 134/84 |
| 6,861,494 | B2 * | 3/2005 | Debruin | 528/272 |
| 6,866,824 | B2 * | 3/2005 | Lafferty et al. | 422/82.05 |
| 6,906,164 | B2 * | 6/2005 | DeBruin | 528/308.1 |
| 6,938,626 | B2 * | 9/2005 | Inagaki | 134/56 R |
| 6,955,834 | B2 * | 10/2005 | Rohrbaugh et al. | 427/180 |
| 6,972,183 | B1 * | 12/2005 | Lafferty et al. | 435/7.4 |
| 6,977,722 | B2 * | 12/2005 | Wohlstadter et al. | 356/246 |
| 6,996,918 | B2 * | 2/2006 | Bsirske et al. | 34/265 |
| 7,019,335 | B2 * | 3/2006 | Suenaga | 257/99 |
| 7,033,781 | B1 * | 4/2006 | Short | 435/69.1 |
| 7,037,636 | B2 * | 5/2006 | Fujita | 430/270.1 |
| 7,077,044 | B2 * | 7/2006 | Badger et al. | 86/50 |
| 7,089,684 | B2 * | 8/2006 | Genier | 34/264 |
| 7,097,392 | B2 * | 8/2006 | Stecher | 406/197 |
| 7,182,818 | B2 * | 2/2007 | Sanders | 127/52 |
| 7,208,592 | B2 * | 4/2007 | Kawanishi et al. | 536/58 |
| 7,211,633 | B2 * | 5/2007 | DeBruin | 526/64 |
| 7,220,761 | B2 * | 5/2007 | Klein et al. | 514/318 |
| 7,240,618 | B2 * | 7/2007 | Badger et al. | 102/293 |
| 7,256,468 | B2 * | 8/2007 | Suenaga | 257/434 |
| 7,309,664 | B1 * | 12/2007 | Marzolin et al. | 442/97 |
| 7,316,185 | B2 * | 1/2008 | Sasayama | 101/484 |
| 7,345,139 | B2 * | 3/2008 | DeBruin | 528/308.1 |
| 7,371,362 | B2 * | 5/2008 | Holles | 423/437.1 |
| 7,420,026 | B2 * | 9/2008 | DeBruin | 528/308.1 |
| 7,423,109 | B2 * | 9/2008 | DeBruin | 528/308.1 |
| 7,446,162 | B2 * | 11/2008 | DeBruin | 528/308.1 |
| 7,476,324 | B2 * | 1/2009 | Ciampi et al. | 210/758 |
| 7,493,857 | B2 * | 2/2009 | Sasayama | 101/484 |
| 7,495,067 | B2 * | 2/2009 | DeBruin | 528/308.1 |
| 7,514,064 | B2 * | 4/2009 | Stecher | 423/574.1 |
| 7,531,618 | B2 * | 5/2009 | DeBruin | 528/308.1 |
| 7,540,324 | B2 * | 6/2009 | de Rouffignac et al. | 166/245 |
| 7,541,423 | B2 * | 6/2009 | DeBruin | 528/308.8 |
| 7,562,707 | B2 * | 7/2009 | Miller | 166/245 |
| 7,631,690 | B2 * | 12/2009 | Vinegar et al. | 166/245 |
| 7,635,024 | B2 * | 12/2009 | Karanikas et al. | 166/245 |
| 2001/0010338 | A1 * | 8/2001 | Ganan-Calvo | 239/8 |
| 2002/0009661 | A1 * | 1/2002 | Hashimoto et al. | 430/106.1 |
| 2002/0028288 | A1 * | 3/2002 | Rohrbaugh et al. | 427/180 |
| 2002/0045010 | A1 * | 4/2002 | Rohrbaugh et al. | 427/372.2 |
| 2002/0046474 | A1 * | 4/2002 | Novak et al. | 34/259 |
| 2002/0059943 | A1 * | 5/2002 | Inagaki | 134/18 |
| 2002/0137877 | A1 * | 9/2002 | Debruin | 528/272 |
| 2002/0139750 | A1 * | 10/2002 | Boyce | 210/652 |
| 2002/0159215 | A1 * | 10/2002 | Siess | 361/232 |
| 2003/0044968 | A1 * | 3/2003 | Lafferty et al. | 435/287.2 |
| 2003/0049841 | A1 * | 3/2003 | Short et al. | 435/449 |
| 2003/0065205 | A1 * | 4/2003 | Tsuyutani et al. | 558/71 |
| 2003/0096220 | A1 * | 5/2003 | Lafferty et al. | 435/4 |
| 2003/0159309 | A1 * | 8/2003 | Bsirske et al. | 34/275 |
| 2003/0180466 | A1 * | 9/2003 | Rohrbaugh et al. | 427/372.2 |
| 2003/0194668 | A1 * | 10/2003 | Kawanishi et al. | 430/641 |
| 2003/0221572 | A1 * | 12/2003 | Matsuura et al. | 101/463.1 |
| 2004/0022677 | A1 * | 2/2004 | Wohlstadter et al. | 422/52 |
| 2004/0044170 | A1 * | 3/2004 | DeBruin | 528/272 |
| 2004/0053163 | A1 * | 3/2004 | Fujita | 430/270.1 |
| 2004/0077090 | A1 * | 4/2004 | Short | 435/471 |
| 2004/0120155 | A1 * | 6/2004 | Suenaga | 362/362 |
| 2004/0170822 | A1 * | 9/2004 | Rohrbaugh et al. | 428/323 |
| 2004/0230025 | A1 * | 11/2004 | DeBruin | 528/271 |
| 2004/0235898 | A1 * | 11/2004 | Klein et al. | 514/318 |
| 2004/0241759 | A1 * | 12/2004 | Tozer et al. | 435/7.2 |
| 2004/0247402 | A1 * | 12/2004 | Stecher | 406/197 |
| 2005/0000545 | A1 * | 1/2005 | Inagaki | 134/18 |
| 2005/0052646 | A1 * | 3/2005 | Wohlstadter et al. | 356/311 |
| 2005/0054814 | A1 * | 3/2005 | DeBruin | 528/308.1 |
| 2005/0070005 | A1 * | 3/2005 | Keller | 435/252.1 |
| 2005/0142033 | A1 * | 6/2005 | Glezer et al. | 422/58 |
| 2005/0175750 | A1 * | 8/2005 | Sanders | 426/481 |
| 2005/0194601 | A1 * | 9/2005 | Suenaga | 257/81 |
| 2005/0241174 | A1 * | 11/2005 | Kolega et al. | 34/93 |
| 2005/0271575 | A1 * | 12/2005 | Ciampi et al. | 423/594.2 |
| 2006/0000108 | A1 * | 1/2006 | Cho et al. | 34/259 |
| 2006/0025307 | A1 * | 2/2006 | Tamagawa | 503/227 |
| 2006/0057358 | A1 * | 3/2006 | Miyake | 428/313.3 |
| 2006/0185543 | A1 * | 8/2006 | Sasayama | 101/463.1 |
| 2006/0185544 | A1 * | 8/2006 | Sasayama | 101/463.1 |
| 2006/0201819 | A1 * | 9/2006 | Matsuura et al. | 205/214 |
| 2006/0205304 | A1 * | 9/2006 | Marzolin et al. | 442/180 |
| 2006/0222786 | A1 * | 10/2006 | Oya et al. | 428/1.31 |
| 2006/0239785 | A1 * | 10/2006 | Stecher | 406/197 |
| 2007/0037959 | A1 * | 2/2007 | DeBruin | 528/272 |
| 2007/0039666 | A1 * | 2/2007 | Hayashi et al. | 148/279 |
| 2007/0043201 | A1 * | 2/2007 | DeBruin | 528/272 |
| 2007/0060738 | A1 * | 3/2007 | DeBruin | 528/272 |
| 2007/0065649 | A1 * | 3/2007 | Matsui et al. | 428/220 |
| 2007/0074420 | A1 * | 4/2007 | Eriksson et al. | 34/275 |
| 2007/0197825 | A1 * | 8/2007 | Holles | 562/515 |
| 2007/0248505 | A1 * | 10/2007 | DeBruin | 422/131 |
| 2007/0257234 | A1 * | 11/2007 | Gerster et al. | 252/407 |
| 2007/0271811 | A1 * | 11/2007 | Tsuruta et al. | 34/263 |
| 2007/0282092 | A1 * | 12/2007 | DeBruin | 528/308.8 |
| 2007/0295701 | A1 * | 12/2007 | Bodroghkozy et al. | 219/121.52 |
| 2008/0026135 | A1 * | 1/2008 | Bentsen et al. | 427/66 |
| 2008/0032071 | A1 * | 2/2008 | Tamagawa | 428/32.2 |
| 2008/0038556 | A1 * | 2/2008 | Galembeck et al. | 428/402 |
| 2008/0053308 | A1 * | 3/2008 | Marzolin et al. | 95/274 |
| 2008/0128134 | A1 * | 6/2008 | Mudunuri et al. | 166/302 |
| 2008/0131812 | A1 * | 6/2008 | Ezure | 430/270.1 |
| 2008/0135244 | A1 * | 6/2008 | Miller | 166/272.6 |
| 2008/0135253 | A1 * | 6/2008 | Vinegar et al. | 166/302 |

2008/0135254 A1* 6/2008 Vinegar et al. ..... 166/303
2008/0138728 A1* 6/2008 Sugino et al. ..... 430/58.75
2008/0142216 A1* 6/2008 Vinegar et al. ..... 166/261
2008/0142217 A1* 6/2008 Pieterson et al. ..... 166/272.6
2008/0185147 A1* 8/2008 Vinegar et al. ..... 166/288
2008/0217003 A1* 9/2008 Kuhlman et al. ..... 166/245
2008/0217004 A1* 9/2008 de Rouffignac et al. ..... 166/245
2008/0217015 A1* 9/2008 Vinegar et al. ..... 166/302
2008/0217016 A1* 9/2008 Stegemeier et al. ..... 166/303
2008/0227931 A1* 9/2008 DeBruin ..... 526/64
2008/0236831 A1* 10/2008 Hsu ..... 166/302
2008/0269382 A1* 10/2008 Gerster et al. ..... 524/104
2008/0275196 A1* 11/2008 DeBruin ..... 526/64
2008/0277113 A1* 11/2008 Stegemeier et al. ..... 166/272.1
2008/0282573 A1* 11/2008 Hein et al. ..... 34/265
2008/0283246 A1* 11/2008 Karanikas et al. ..... 166/302
2008/0312406 A1* 12/2008 DeBruin ..... 528/307
2009/0014180 A1* 1/2009 Stegemeier et al. ..... 166/302
2009/0014181 A1* 1/2009 Vinegar et al. ..... 166/302
2009/0050558 A1* 2/2009 Ishizuka et al. ..... 210/500.21
2009/0119990 A1* 5/2009 Johnson et al. ..... 48/61
2009/0119991 A1* 5/2009 Johnson et al. ..... 48/78
2009/0119992 A1* 5/2009 Johnson et al. ..... 48/89
2009/0119994 A1* 5/2009 Johnson et al. ..... 48/62 R
2009/0126270 A1* 5/2009 Johnson et al. ..... 48/61
2009/0126276 A1* 5/2009 Johnson et al. ..... 48/62 R
2009/0162307 A1* 6/2009 Fritzsche et al. ..... 424/65
2009/0189617 A1* 7/2009 Burns et al. ..... 324/649
2009/0194269 A1* 8/2009 Vinegar ..... 166/60
2009/0194282 A1* 8/2009 Beer et al. ..... 166/272.7
2009/0194286 A1* 8/2009 Mason ..... 166/302
2009/0194287 A1* 8/2009 Nguyen et al. ..... 166/302
2009/0194329 A1* 8/2009 Guimerans et al. ..... 175/17
2009/0194333 A1* 8/2009 MacDonald ..... 175/45
2009/0194524 A1* 8/2009 Kim ..... 219/544
2009/0200022 A1* 8/2009 Bravo et al. ..... 166/256
2009/0200023 A1* 8/2009 Costello et al. ..... 166/260
2009/0200025 A1* 8/2009 Bravo ..... 166/265
2009/0200031 A1* 8/2009 Miller et al. ..... 166/302
2009/0200290 A1* 8/2009 Cardinal et al. ..... 219/488
2009/0200854 A1* 8/2009 Vinegar ..... 299/5
2009/0229140 A1* 9/2009 Dedieu ..... 34/259
2009/0286295 A1* 11/2009 Medoff et al. ..... 435/162

FOREIGN PATENT DOCUMENTS

FR 2695196 3/1994
WO WO 8808949 11/1988
WO WO 0237043 5/2002

* cited by examiner

METHOD FOR DEHUMIDIFICATION

TECHNICAL FIELD

The present invention concerns a method and an apparatus for dehumidifying, drying or the like of many different types of material. The material for dehumidifying or the like may be chemical and organic materials, such as sewage sludge, colour, foodstuffs, parts of humans or animals.

PRIOR ART

The present invention is based on the concept of employing thermal radiation.

Thermal radiation has the characteristic property that it requires no medium for transferring energy between two bodies. This may be likened to the energy of the sun, which is conveyed to the earth.

Radiation having relatively short wavelengths will penetrate into openings of the surface layer of the material to be dehumidified, dried or the like. The radiation going through these openings will be reflected multiple times from moisture molecule to moisture molecule. If the moisture is absorbent enough, the likelihood is low that any part of the radiation will go out through the openings formed in the molecular structure of the material. Thus, the material will form a black surface.

The above process may be named "radiation of void", thus applying for radiation having wavelengths shorter than the openings of the surface structure. Due to the small openings in the molecular structure of the material to be dehumidified the radiation will be isotropic, i.e. the intensity is the same in all directions.

In the inner part of the material to be dehumidified and having its voids the radiation will have the spectral distribution described by Kirchhoff's law:

$$\frac{e_1(\lambda, T)}{a_1(\lambda, T)} = \frac{e_2(\lambda, T)}{a_2(\lambda, T)} = \cdots e_s(\lambda, T)$$

and Stefan-Boltzmann's law regarding the total intensity:

$$E_s = \int_0^{28} e_s(\lambda, T) \cdot d\lambda = \sigma \cdot T^4$$

The present invention is mainly developed for treatment, i.e. dehumidification, sanitation or drying, of sewage sludge, but a person skilled in the art realises that it may be used for many different materials.

The present invention is also appropriate for dehumidification or drying of some foodstuffs. Suitable foodstuffs may be crispbread, pasta etc.

In order to simplify the description the invention will be described mainly with sewage sludge as an example. If at all treated sewage sludge at the present is often heated to rather high temperatures in the region of 800-900° C. Such high temperatures make demands on the apparatus used, especially the vessel holding the sludge during heating. However, sewage sludge is normally just used for landfilling or deposition.

SUMMARY OF THE INVENTION

The present invention is based on the concept of only employing radiation energy (thermal radiation) for heating the sludge or other material and that the radiation employed encompasses a wave length range within which water has a high absorption coefficient. The radiation at other wavelengths is reduced.

A heat source is used to emit heat radiation. Vaporised moisture will be taken away by circulating air from the surface of the material to be dehumidified. The vaporisation of moisture of the material is done by means of absorption and reflection. The heat source will emit heat radiation at wavelengths at which water has high capacity of absorption, with absorption coefficients larger than 1000 $cm^{-1}$.

With radiation energy in a narrow wavelength band where the water has a high absorption capability, the radiation energy is transmitted direct to the water molecules in the material to be dehumidified. This result in relatively short drying times, relatively low energy consumption and normally no negative influence on the material to be dehumidified. Dehumidifying using "the void principal" as indicated above will give a low consumption of energy.

For sewage sludge the moisture ratio after drying should be 20% or less. By using the method of the present invention the moisture ratio may be decreased well below 20%. In the drying process the sludge will also be sanitised to a certain degree. As the sludge is heated to 70-120° C. in the process most bacteria of the sludge will be killed. The sanitised sludge may be recycled, i.e. it may be placed on e.g. fields for standing crops.

The method of the present invention can be used as a part of an ecological system of recycling. By such a system a number of advantages may be reached. The dried and sanitised material, such as sewage sludge may be deposit or burned. The amount of refuse is reduced, decreasing the use of resources. If the dehumidified sludge is burned different materials may be recovered, saving resources and energy compared to using fresh raw material. It is possible to recover heavy metals, chromium, nickel, copper etc. from the ash after burning. It is possible to recover plant nutrients, such as phosphorous being a limited resource, for use in the cultivation of plants. The dehumidified and sanitised sludge normally has a high energy value, e.g. 2.5-3.5 MWh/ton. Thus, it may be used as fuel.

DETAILED DESCRIPTION OF PREFERRED EMBODIMENT

Figure 1:
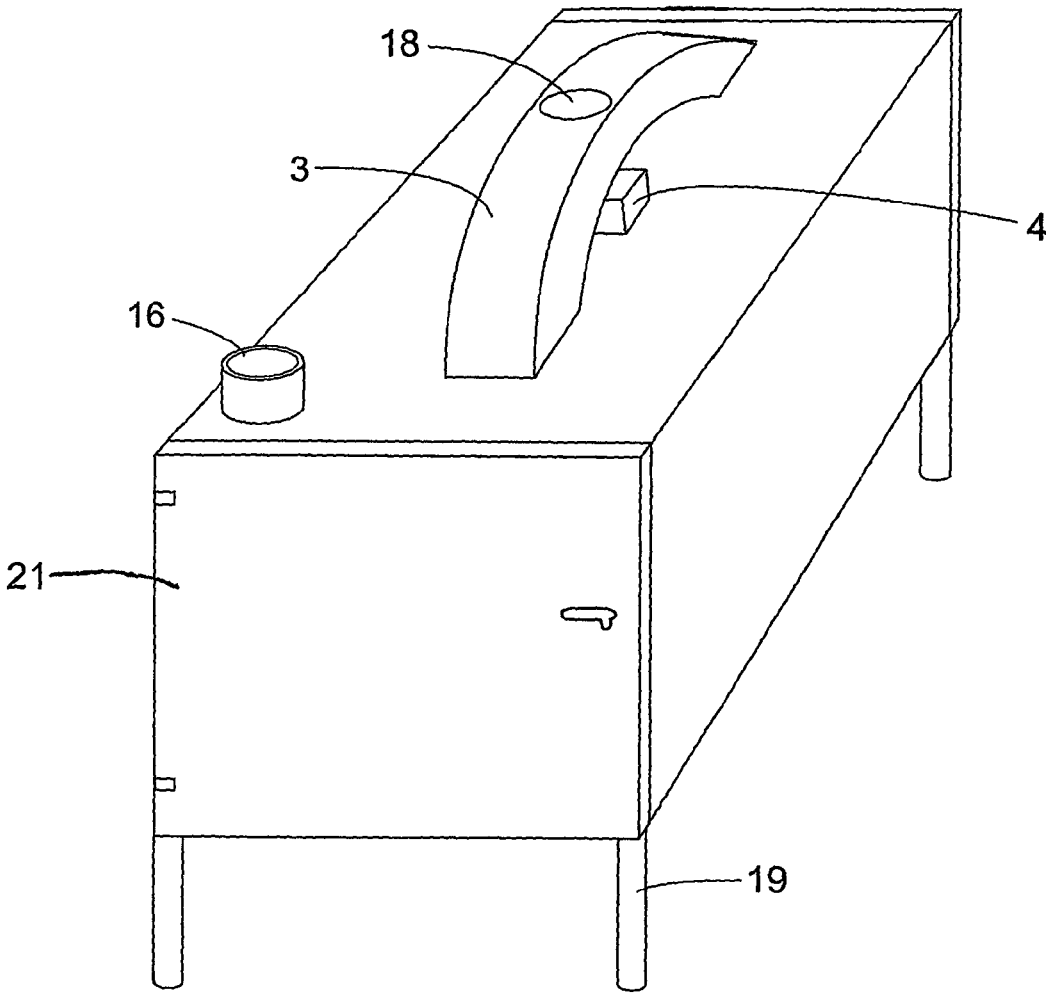
FIG. 1 is a perspective view of a drying chamber according to the present invention.
Figure 2:
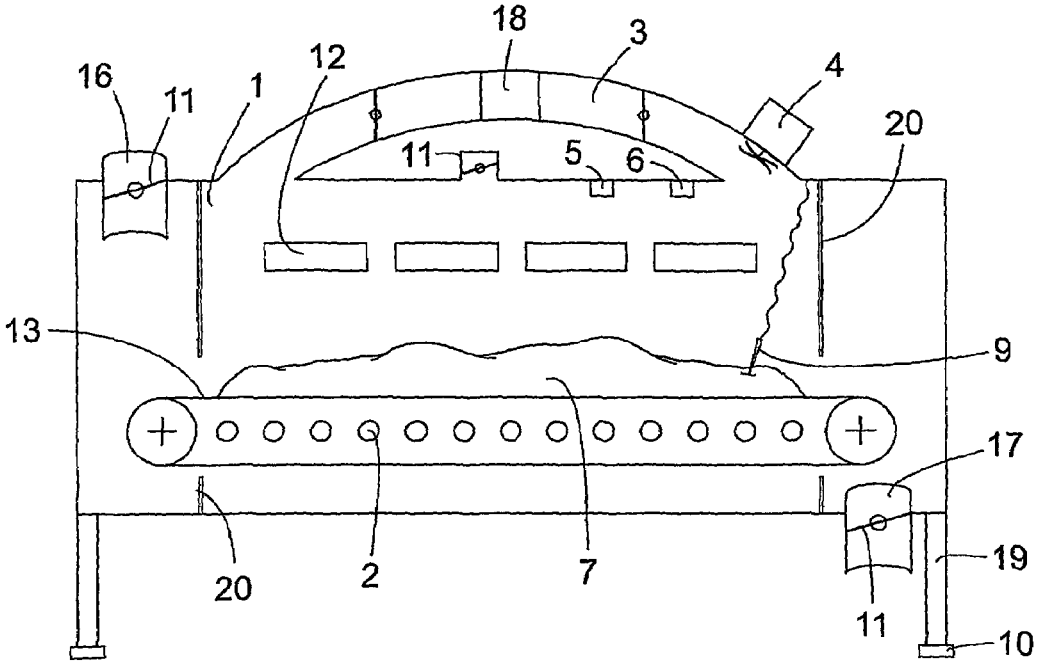
FIG. 2 is a sectional side view of a modified chamber according to the present invention.
Figure 3:
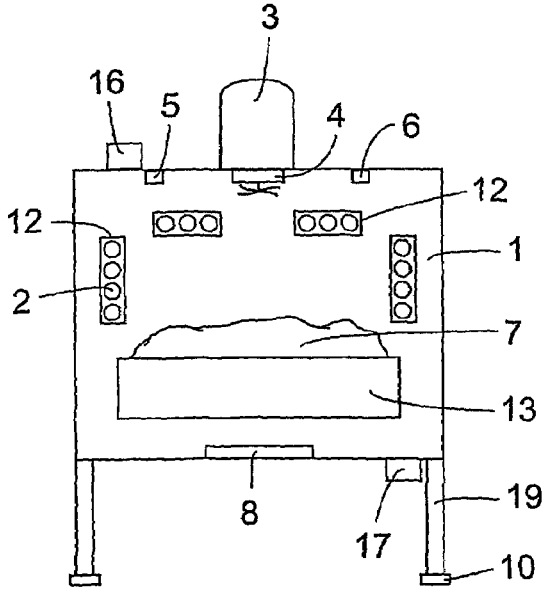
FIG. 3 is an "open" end view in sketch form of a chamber according to the present invention.

FIGS. 1-3 show one embodiment of a drying apparatus including a drying chamber 1 in which the drying of the sludge or other material takes place.

The expression "element" 2 will be employed below to refer to a radiation source. The element is designed as a device emitting radiation comprising a selected wavelength region.

In one embodiment the elements 2 are made of a central electric resistor 15 surrounded by a tube 14. In other embodiments the electric resistor is replaced by hot water as the radiation source of the element 2. Also other energy media is possible to use as the radiation source. Independent of which energy media that is used, it should be surrounded by a tube 14. Furthermore, the energy medium may be made more effective by the use of a plasma or a dielectric.

The elements 2 may be placed in racks or frames 12. Reflectors are normally placed in connection with the elements. In order to realise good reflection of the radiation, the reflectors are generally made of aluminium, stainless steel or other high-reflective material. In the frequencies employed, these materials display reflection coefficients exceeding 95%. Radiation which impinges on the reflectors is guided by them back to the sludge. It is not a requirement that reflectors are employed, but they do contribute to a reduction in energy consumption. Normally, the elements 2 are disposed in any optional direction whatever in relation to the longitudinal direction of the drying chamber 1.

As a rule, the walls of the chamber are clad on the inside with stainless and/or acid proof steel, aluminium or similar high-reflective material for radiation within the above-indicated selected wavelength region. In other words, the interior of the drying chamber is designed as a large reflector. The walls are generally thermally insulating. As shown in FIG. 1 a door 21 is arranged at each end of the chamber 1. In other embodiments there is a door 21 only at one end of the chamber 1, in which case the sludge 7 or other material is taken in and out of the chamber 1 at the same end.

The sludge 7 is normally received on a conveyor belt 13. In some embodiments a conveyor belt 13 of stainless steel is used to support the material to be dehumidified, reflecting some radiation back to the sludge 7. In some embodiments the conveyor belt 13 is made of a net of wires of stainless steel or the like. If the conveyor belt has a mesh form some elements 2 are placed in the centre of the conveyor, i.e. between the upper and lower horizontal parts of the conveyor. In other embodiments the sludge 7 is received on one or more carriages, that may be rolled into and out of the drying chamber 1. Also the carriages may have sludge receiving surfaces of a high reflective material, such as stainless steel. If a conveyor belt 13 is arranged in the chamber 1, the sludge 7 is normally feed in at one end of the conveyor and feed out at the other end. During the dehumidification process the conveyor belt is normally at a standstill.

The drying chamber 1 is normally placed on legs 19. The drying chamber 1 is, in the illustrated embodiment, provided with a circulation fan 4 and a ventilation damper 11. An air inlet 16 and an air outlet 17 are placed at opposite ends of the chamber 1. Both the air inlet 16 and the air outlet 17 are normally furnished with dampers, to open and close the inlet 16 and outlet 17, respectively. Normally, the areas of the air inlet and outlet, respectively, are separated from the proper drying chamber 1 by partitions 20. The partitions 20 normally have openings for the conveyor belt 13. Furthermore, a conduit 3 for recirculation of air is provided, giving recovery of energy. A heat exchanger 18 is placed in the conduit 3 for recirculation. The conduit 3 including the heat exchanger 18 makes it possible to dehumidify and recirculate the air of the drying chamber. Furthermore dampers 11 are placed at each end of the conduit 3.

In one embodiment, as indicated in FIG. 2 the active part of the circulation fan 4 is placed in the conduit 3. In other embodiments, as indicated in FIG. 1, the active part of the circulation fan 4 is placed inside the chamber 1. The circulation fan 4, irrespective of the exact placing, circulates the air in the drying chamber 1 and thereby conveys off moisture, which departs from the surface of the sludge 7. The task of the fan system is to circulate the air around the sludge and thereby entrain moisture from the surface of the sludge. In the present invention, use is normally made of a flow rate of 1-5 m/s.

The ventilation damper 11 is employed for regulating the air velocity and the speed of dehumidification in the drying chamber 1. In some embodiments there are more then one damper 11.

In the drying apparatus, there is disposed an indicator 5 for measuring the temperature in the drying chamber 1 and/or of the air which departs from and/or is fed to the drying chamber 1. Also the temperature of the sludge 7 may be controlled. Different indicators for different temperatures may be used, measuring both the "wet" and "dry" temperatures. For a "wet" thermometer water is cooled by evaporation until equilibrium, i.e. the heats of evaporation and volatilisation are the same. The dampers 11 of the chamber 1 may be controlled by the wet temperature. Normally an indicator 9 measuring the temperature of the sludge 7 is used. Said indicator 9 is placed in the sludge 7. In certain embodiments, there are also indicators 6, which measure the moisture ratio of the drying chamber 1. For accurate monitoring of the air humidity in the chamber, use is made of indicators 6 that measure the relative air humidity. As indicator for the relative air humidity a psychrometer is used in some embodiments. In order to measure the decrease of the moisture in the sludge 7, use is made, in certain embodiments, of a weighing machine. The weighing may be performed in that the chamber is placed on scales or load sensing elements 10. Said scales or load sensing elements 10 are in some embodiments integrated in the legs 19 on which the chamber 1 is placed.

In some embodiments of the present invention a condenser 8 placed below the conveyer belt 13 is used. By means of the condenser 8 some energy is recovered.

As stated above drying of the sludge 3 takes place with the aid of the elements 2. These elements 2 emit a radiation in a limited wavelength interval adapted to the absorption of water.

Figure 4:
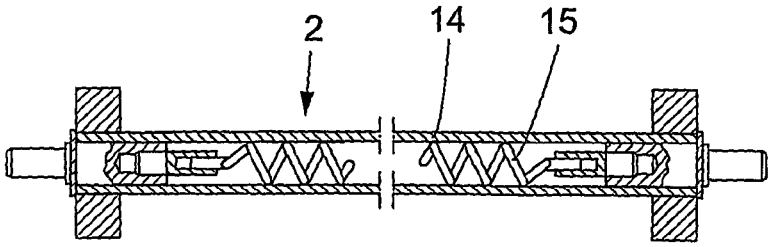
FIG. 4 is a sectional view of one example of a heat source to be used in the chamber of the present invention.

In the embodiment according to FIG. 4, the element 2 consists of an electric resistor 15 disposed centrally in the tube 14 and heated when current from a voltage source passes through the resistor via conductors (not shown).

The wavelength band has been selected at the range of approx. 2-20 μm and as a rule approx. 5-20 μm, a range that encompasses wavelengths at which the absorption of radiation by water is great. In such instance, use is made of the fact that, within these ranges, water has peaks with absorption coefficients higher than 1,000 $cm^{-1}$.

The water has peaks at approx. 3 μm, 6-7 μm and 10-20 μm regarding the absorption. Between approx. 7 μm and 10 μm the absorption coefficient of water is lower, sinking under 1,000 $cm^{-1}$. Thus, to maximise the effect of the radiation of the elements 2, they should have maximal intensity at the frequencies where water has maximal absorption, while the radiation at other wavelengths should be reduced.

Thus, one object of the present invention is to have a radiation with maximal intensity at the wavelengths where water has a high absorption coefficient, while the intensity is reduced at other wavelengths. The peak at 3 μm is rather thin and demands a very high temperature making it less suitable to use. Furthermore, it is very hard and even virtually impossible, to reduce the radiation at the wavelength range approx. 4-6 μm. In view of this the intensity of the radiation of the elements is directed to the intervals approx. 6-7 μm and 10-20 μm and the intensity is reduced in the intermediate area, i.e. approx. 7-10 μm. Thus, the energy of the radiation is used in a way to give maximal effect.

The intensity is dependent on the material of the elements according to the following formula:

$$I=I_0e^{-\alpha x}$$

where I is the intensity, e is the natural logarithm and $\alpha$ is a constant depending on the material of the tube 14 or the like surrounding the resistor 15. By varying the material it is possible to control both the spectrum and the position of the radiation of the elements 2. This is used according to the present invention in such a way that the radiation of the elements 2 are adapted to the absorption of water as indicated above. Thus, according to the present invention the material surrounding the electrical resistor 15 is chosen to give the desired radiation spectrum of the element 2. Said material may be any material giving the desired properties. According to known technology, there is a plurality of examples of how, by suitable material selection and suitable current force, to obtain the working temperature of the radiation source which entails that the radiation is maximised within the wavelength interval at which water best absorbs radiation.

Normally the conveyor belt 13, and thus, the sludge 7, is at standstill during the treatment phase. The treatment phase is normally an automated process, controlled by use of one or more of the different indicators referred to above. The process may be controlled using either the moisture ratio of the chamber 1 or sludge 7, or time as independent variable. By using a thermometer in the circulating air or the sludge 7 dehumidification may be conducted at a certain temperature level of the chamber 1 or sludge 7, respectively. A combination of these temperatures may be used as depending variables.

Usually a control system (PLC system) is provided for controlling the elements 2, the fan 4 and the damper 11 in response to signals received from the indicators 5, 6, 9, 10. The control system may also be referred to as a registration and calculation unit. Normally the process is run automatically, but a person skilled in the art realises that the process may also be run manually by continuous monitoring of the values of the indicators 5, 6, 9.

The temperature in the drying chamber 1 is governed with the aid of the elements 2. In the process often the temperature of the sludge 7 is kept at a fixed level (e.g. ±1° C.). It is also possible to keep the temperature of the chamber 1 at a fixed level. To keep any of said fixed temperature levels the elements 2 are turned on and off based on the temperature of the sludge 7 or chamber 1, respectively. For treatment of sewage sludge the air temperature in the chamber 1 is kept at about 150° C. and the temperature of the sewage sludge is held at about 50-120° C. The process goes on until the moisture ratio of the sludge 7 has decreased into a predetermined level. As an alternative to the moisture level the process may be run for a predetermined time. To kill of bacteria the temperature of the sludge 7 may be raised for a short period, usually in the end of the process.

After the dehumidification process the sludge 7 is treated whether any material are to be recovered before or after a possible burning, whether it should be spread on the ground, whether it should be used as a fuel etc.

A drying process for foodstuffs, such as crispbread, pasta etc., is run after the same principals as described above. The type and number of indicators used will be adapted to the material to be dried.

The invention claimed is:

1. A method for dehumidification and sanitation of sewage sludge in a chamber, the method comprising:

receiving the sewage sludge on a conveyor made of net that is located inside the chamber;

emitting thermal radiation from at least one element in the chamber, wherein the at least one element is positioned between an upper part and a lower part of the conveyor, the thermal radiation is concentrated to one or more distinct wavelength ranges at which water has peaks for absorption of radiation energy, and the wavelengths of the thermal radiation are shorter than the openings of the surface structure of the sewage sludge;

circulating air in the chamber using a fan to take up moisture evaporated from the sewage sludge;

recovering energy from the moisture using a condenser; and maintaining the sewage sludge at a constant temperature within the range of 70-120° C. during the dehumidification cycle.

2. The method of claim 1, wherein the at least one element emits thermal radiation that is concentrated to exact wavelength ranges where the water has an absorption coefficient greater than approximately 1,000 $cm^{-1}$, while the radiation is reduced in other areas.

3. The method of claim 2, wherein the radiation is concentrated to the wavelength ranges of approximately 6-7 μm and approximately 10-20 μm, while the radiation in the intermediate range of approximately 7-10 μm is reduced.

4. The method of claim 1, further comprising monitoring the prevailing moisture ratio and/or the temperature of the sewage sludge and/or the chamber.

5. The method of claim 4, wherein the moisture ratio of the sewage sludge and/or the chamber is monitored by means of one or more indicators.

6. The method of claim 4, wherein the moisture ratio of the sewage sludge and/or the chamber is monitored by means of a weighing machine, monitoring the total weight of the chamber.

7. The method of claim 1, further comprising circulating the air of the chamber through a conduit going from one end of the chamber to the opposite end;

wherein a heat exchanger is placed in the conduit for recovery of energy.

8. The method of claim 1, wherein the thermal radiation is reflected on high-reflective material on the inside of the chamber.

9. An apparatus for dehumidification and sanitation of sewage sludge in accordance with the method as claimed in claim 1, wherein the apparatus comprises:

indicators for sensing the temperature and/or moisture ratio of the chamber and/or the sewage sludge; and a control system (PLC system) for controlling the at least one element and the fan in response to signals received from the indicators.

10. The apparatus of claim 9, wherein the at least one element is mounted in a rack having surfaces displaying high reflectance.

11. The apparatus of claim 9, wherein the inside of the chamber is made of or clad with a material displaying high reflectance;

wherein the chamber is provided with an air inlet, an air outlet, a fan system, and a conduit, including a heat exchanger, for recirculation of the air of the chamber and one or more ventilation dampers;

wherein indicators are provided for sensing temperature and air humidity in the chamber;

wherein indicators are provided for sensing the weight of the sewage sludge; and wherein the signals from all indicators are fed to a calculation and control device.

12. The apparatus of claim 9, wherein the condenser is placed inside the chamber.

13. The apparatus of claim 9, wherein the at least one element comprises an electrical resistor surrounded by a tube that is made of material having properties to give the desired radiation spectrum.

14. The method of claim 1, further comprising:

recovering plant nutrients from the sewage sludge.

15. The method of claim 1, further comprising:

heating the at least one element using an energy carrying medium.

* * * * *